US007284537B2

(12) United States Patent
Kleinbeck et al.

(10) Patent No.: US 7,284,537 B2
(45) Date of Patent: Oct. 23, 2007

(54) HIGH-PRESSURE PUMP FOR A FUEL-INJECTION DEVICE OF AN INTERNAL COMBUSTION ENGINE

(75) Inventors: Thomas Kleinbeck, Vaihingen/Enz (DE); Markus Koch, Stuttgart (DE); Wolfram Rittmannsberger, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/568,811

(22) PCT Filed: Jun. 22, 2004

(86) PCT No.: PCT/DE2004/001303

§ 371 (c)(1),
(2), (4) Date: Feb. 21, 2006

(87) PCT Pub. No.: WO2005/026541

PCT Pub. Date: Mar. 24, 2005

(65) Prior Publication Data

US 2006/0280620 A1 Dec. 14, 2006

(30) Foreign Application Priority Data

Aug. 21, 2003 (DE) ..... 203 13 014 U

(51) Int. Cl.
*F02M 41/00* (2006.01)
*F02M 41/04* (2006.01)

(52) U.S. Cl. ..... 123/450; 417/273

(58) Field of Classification Search ..... 123/495, 123/446, 448, 449, 450; 91/129, 158, 159, 91/72, 66, 61, 153, 155; 417/273, 269
See application file for complete search history.

(56) References Cited

U.S. PATENT DOCUMENTS

| | | | | |
|---|---|---|---|---|
| 5,462,362 | A | 10/1995 | Yuhta et al. | |
| 5,642,988 | A | 7/1997 | Zorn | |
| 5,937,734 | A | 8/1999 | Stiefel et al. | |
| 6,237,441 | B1 | 5/2001 | Nishioka et al. | |
| 2003/0089343 | A1 | 5/2003 | Yamaguchi et al. | |
| 2003/0180159 | A1* | 9/2003 | Blessing et al. | 417/273 |
| 2006/0093490 | A1* | 5/2006 | Kleinbeck et al. | 417/273 |

FOREIGN PATENT DOCUMENTS

| | | |
|---|---|---|
| EP | 0 984 161 A1 | 3/2000 |
| EP | 1 310 577 A1 | 5/2003 |

* cited by examiner

*Primary Examiner*—Mahmoud Gimie
(74) *Attorney, Agent, or Firm*—Ronald E. Greigg

(57) ABSTRACT

A high-pressure pump having a rotationally driven drive shaft with a shaft portion embodied eccentrically to its axis of rotation, on which shaft portion a ring is rotatably supported. At least one pump element, has a pump piston, driven at least indirectly in a reciprocating motion by the drive shaft via the ring and resting at least indirectly on the ring. The ring is provided, at least on its outer face facing away from the shaft portion, with a coating of a friction-reducing paint in at least one region, in which the at least one pump piston rests at least indirectly on the ring.

20 Claims, 2 Drawing Sheets

HIGH-PRESSURE PUMP FOR A FUEL-INJECTION DEVICE OF AN INTERNAL COMBUSTION ENGINE

CROSS-REFERENCE TO RELATED APPLICATIONS

This application is a 35 USC 371 application of PCT/DE 2004/001303 filed on Jun. 22, 2004.

BACKGROUND OF THE INVENTION

1. Field of the Invention

The invention is directed to an improved high-pressure pump for a fuel injection system of an internal combustion engine.

2. Description of the Prior Art

One high-pressure pump known from German Patent Disclosure DE 198 44 272 A1 employs a rotationally driven drive shaft, which has a shaft portion embodied eccentrically to the axis of rotation of the drive shaft. A polygonal ring is rotatably supported on the eccentric shaft portion. The high-pressure pump has at least one pump element, with at least one pump piston driven in a reciprocating motion at least indirectly by the drive shaft via the ring. The ring, on its circumference, has flat faces, corresponding in number to the pump elements, on which faces the pump pistons rest at least indirectly, for instance via a tappet. In operation of the high-pressure pump, heavy loads on the ring and the pump pistons or tappets, especially high pressures per unit of surface area, occur. Moreover, sliding motions can occur between the ring and the pump pistons or tappets. Lubricating the contact region between the ring and the pump pistons or tappets is done by means of the fuel present in the interior of the high-pressure pump housing. Particularly at high fuel temperatures, however, the lubrication provided by the fuel is no longer sufficient, so that severe wear of the ring and/or the pump pistons or tappets occurs, which finally can cause failure of the high-pressure pump.

SUMMARY AND ADVANTAGES OF THE INVENTION

The high-pressure pump according to the invention has the advantage over the prior art that because of the friction-reducing paint coating of the ring, adequate wear resistance of the contact region between the ring and at least indirectly the at least one pump piston is assured.

Advantageous features and refinements of the high-pressure pump of the invention are disclosed. The combination of a nitrocarburized surface layer and the coating of friction-reducing paint applied to it makes especially good wear resistance possible. The coating of friction-reducing paint provides a running-in aid at the beginning of operation of the high-pressure pump, so that the microtopographies of the surfaces of the ring and at least indirectly of the pump piston can adapt to one another. Moreover, as a result of the pressure that occurs in operation of the high-pressure pump between the ring and at least indirectly the pump piston, friction-reducing paint ingredients are pressed into the large-pore seam of the nitrocarburized surface layer of the ring. This creates lubricant reservoirs of friction-reducing paint ingredients, from which, when the high-pressure pump is running hot at high fuel temperatures, solid lubricant particles are exported continuously, thereby preventing inadequate lubrication.

BRIEF DESCRIPTION OF THE DRAWINGS

One exemplary embodiment of the invention is described herein below, in conjunction with the drawings, in which.

DESCRIPTION OF THE PREFERRED EMBODIMENT

Figure 1:
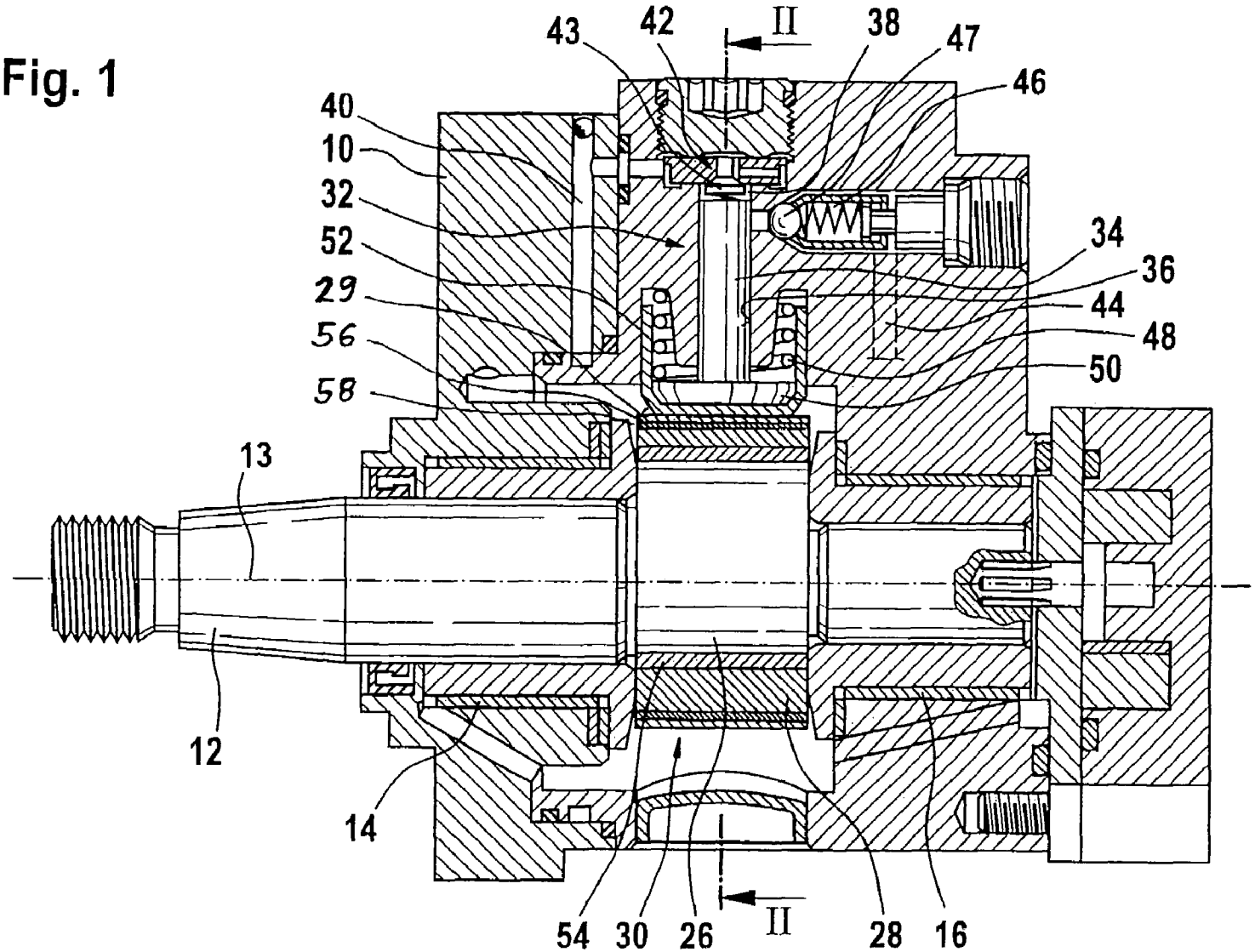
FIG. 1 shows a fuel injection system of an internal combustion engine with a high-pressure pump.
Figure 2:
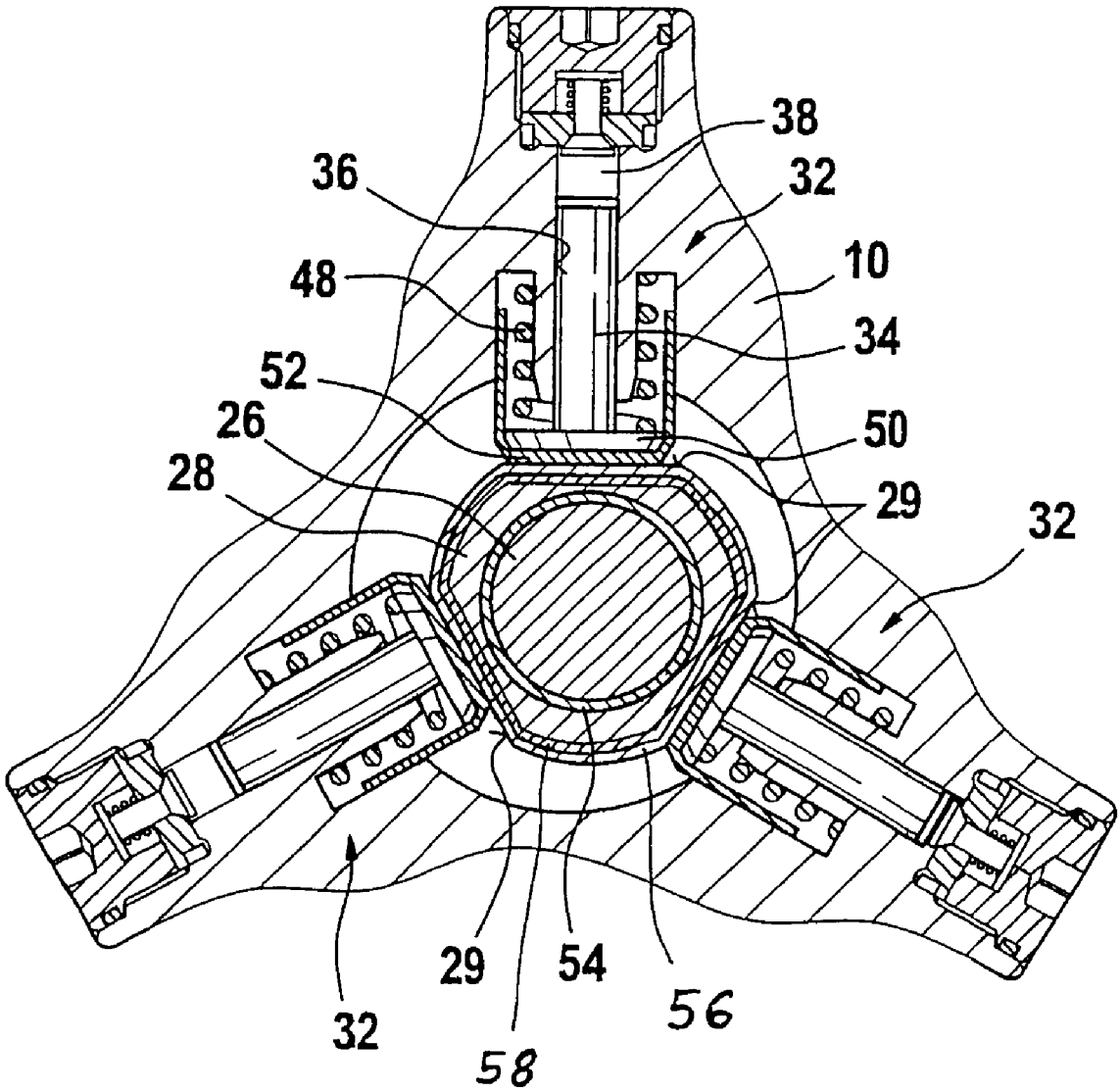
FIG. 2 shows the high-pressure pump in a cross section taken along the line II-II in FIG. 1.

In FIGS. 1 and 2, a high-pressure pump for a fuel injection system of an internal combustion engine is shown. The high-pressure pump has a housing 10, which is embodied in multiple parts, and in which a drive shaft 12 is located. The drive shaft 12 is rotatably supported in the housing 10 via two bearing points 14 and 16, spaced apart from one another in the direction of the axis of rotation 13 of the drive shaft 12. The bearing points 14, 16 may be located in different parts of the housing 10.

In a region located between the two bearing points 14, 16, the drive shaft 12 has a shaft portion 26, embodied eccentrically to the axis of rotation 13 of the drive shaft, on which portion a transmission element 28, in the form of a polygonal ring, is rotatably supported via a bearing point 30. The high-pressure pump has at least one and preferably a plurality of pump elements 32, located in the housing 10, each with a respective pump piston 34 that is driven by the polygonal ring 28 in a reciprocating motion in an at least approximately radial direction to the axis of rotation 13 of the drive shaft 12. The pump piston 34 is guided tightly displaceably in a cylindrical bore 36 in the housing 10 or in an insert in the housing 10, and with its face end facing away from the transmission element 28, it defines a pump work chamber 38 in the cylindrical bore 36. The pump work chamber 38 has a communication, via a fuel inlet conduit 40 extending in the housing 10, with a fuel supply, such as a feed pump. At the mouth of the fuel inlet conduit 40 into the pump work chamber 38, there is an inlet valve 42, which opens into the pump work chamber 38 and has a spring-loaded valve member 43. The pump work chamber 38 furthermore has a communication, via a fuel outlet conduit 44 extending in the housing 10, with an outlet, which for instance communicates with a reservoir. At the mouth of the fuel outlet conduit 44 into the pump work chamber 38, there is an outlet valve 46, which opens out of the pump work chamber 38 and likewise has a spring-loaded valve member 47.

The pump piston 34 is kept with its piston base 50 in contact with the polygonal ring 28 directly by a prestressed spring 48 or via a tappet 52. Upon the rotary motion of the drive shaft 12, the polygonal ring 28 is not rotated with it but instead, because of the eccentric portion 26, executes a motion perpendicular to the axis of rotation 13 of the drive shaft 12, which causes the reciprocating motion of the pump piston 34. The polygonal ring 28, in its outer jacket, has flat face 29 for each pump element 32, on which face the piston base 50 or the tappet 52 rests. In the intake stroke of the pump piston 34, in which this piston moves radially inward, the pump work chamber 38 is filled with fuel through the fuel inlet conduit 40 with the inlet valve 42 open and the outlet valve 46 closed. In the pumping stroke of the pump piston 34, in which this piston moves radially outward, fuel under high pressure is fed by the pump piston 34 through the fuel outlet conduit 44 to a reservoir, not shown, with the outlet valve 46 open and the inlet valve 42 closed.

The polygonal ring 28 is supported on the shaft portion 26 directly via the bearing point 30, that is, without any bearing bush, or via a bearing bush. The polygonal ring 28 may be provided, on its inside face oriented toward the shaft portion 26, with a coating 54 of a friction-reducing paint. Alternatively or in addition, the shaft portion 26 may also be provided with a coating 54 of a friction-reducing paint on its outer face oriented toward the polygonal ring 28. The coating 54 has a thickness between approximately 10 and 50 μm, and preferably between approximately 15 and 30 μm. The coating 54 comprises a friction-reducing paint having the requisite properties in terms of coefficient of friction, wear resistance, and temperature resistance for use at the bearing point 30. Because of the coating 54, low friction and adequate wear resistance of the bearing point 30 are assured even if the bearing point 30 is lubricated only with the fuel present in the interior of the housing 10. For a given size of the outer cross section of the polygonal ring 28, this ring can be embodied with a relatively great wall thickness because of the slight thickness of the coating 54 and the slight inside diameter made possible as a result.

The polygonal ring 28 is provided, on its outer face facing away from the shaft portion 26, with a coating 56 of a friction-reducing paint at least in the region of the flat faces 29. The polygonal ring 28 may also be provided with the coating 56 of friction-reducing paint over its entire surface. The coating 56 of friction-reducing paint has a thickness between approximately 10 and 50 μm, preferably between approximately 15 and 30 μm. The friction-reducing paint for the coating 56 is applied in liquid or powdered form to the polygonal ring 28 and then hardened at elevated temperature. The friction-reducing paint at least substantially comprises a paint with incorporated particles of solid lubricant.

Preferably at least in the region of the flat faces 29, the polygonal ring 28 is provided with a nitrocarburized surface layer 58. The ring 28 may have the nitrocarburized surface layer 58 over its entire surface. This surface layer 58 is created by introducing the polygonal ring 28 into a salt bath. The nitrocarburized surface layer 58 has a thickness of approximately 5 to 20 μm, preferably approximately 10 μm. The surface layer 58 has an outer region with pores and an inner, pore-free region with a thickness of at least 5 μm.

The polygonal ring 28 is of steel, preferably an alloy 16MnCrS5. The polygonal ring 28 is quenched and tempered, then placed in the salt bath, where the nitrocarburized surface layer 58 is created, and finally, the coating 56 of friction-reducing paint is applied to this surface layer 58 and hardened.

The coating 56 of friction-reducing paint provides a running-in aid at the beginning of operation of the high-pressure pump, so that the microtopographies of the surfaces, contacting one another, of the flat faces 29 of the polygonal ring 28 and of the piston base 50 or tappet 52 can adapt to one another. Moreover, as a result of the pressure occurring in operation of the high-pressure pump between the polygonal ring 28 and the piston base 50 or the tappet 52, friction-reducing paint ingredients are pressed into the large-pore seam, that is, the outer region of the nitrocarburized surface layer 58, of the polygonal ring 28. This creates lubricant reservoirs of friction-reducing paint ingredients, from which, if the high-pressure pump is running hot at high fuel temperatures, solid lubricant particles are continuously exported, thus preventing inadequate lubrication between the polygonal ring 28 and the piston base 50 or the tappet 52.

The foregoing relates to preferred exemplary embodiments of the invention, it being understood that other variants and embodiments thereof are possible within the spirit and scope of the invention, the latter being defined by the appended claims.

The invention claimed is:

1. A high-pressure pump for a fuel injection system of an internal combustion engine, the pump comprising a rotationally driven drive shaft including a shaft portion, embodied eccentrically to the axis of rotation of the drive shaft, a ring rotatably supported on the shaft portion, at least one pump element having a pump piston resting at least indirectly on the ring and driven at least indirectly in a reciprocating motion by the drive shaft via the ring, and a coating of a friction reducing paint applied to and hardened on the ring at least on the outer face of the ring facing away from the shaft portion in at least one region, the at least one region being where the at least one pump piston rests at least indirectly on the ring.

2. The high-pressure pump according to claim 1, wherein the ring further comprising at least one flat face on the circumference of the ring, on which flat face the pump piston rests at least indirectly and wherein the at least one flat face is provided with the coating of friction-reducing paint.

3. The high-pressure pump according to claim 2, wherein the coating of friction-reducing paint has a thickness of approximately 10 to 50 μm, preferably approximately 15 to 30 μm.

4. The high-pressure pump according to claim 2, wherein the ring comprises an alloy 16MnCrS5.

5. The high-pressure pump according to claim 1, wherein the coating of friction-reducing paint has a thickness of approximately 10 to 50 μm, preferably approximately 15 to 30 μm.

6. The high-pressure pump according to claim 5, wherein the ring comprises an alloy 16MnCrS5.

7. The high-pressure pump according to claim 1, wherein the ring comprises an alloy 16 MnCrS5.

8. A high-pressure pump for a fuel injection system of an internal combustion engine, the pump comprising a rotationally driven drive shaft including a shaft portion, embodied eccentrically to the axis of rotation of the drive shaft, a ring is rotatably supported on the shaft portion, at least one pump element having a pump piston resting at least indirectly on the ring and driven at least indirectly in a reciprocating motion by the drive shaft via the ring, and a coating of a friction reducing paint on the ring at least on the outer face facing away from the shaft portion in at least one region in which the at least one pump piston rests at least indirectly on the ring, wherein the ring, at least in the region in which the coating of friction-reducing paint is applied, comprises a nitrocarburized surface layer, onto which the coating of friction-reducing paint is applied.

9. The high-pressure pump according to claim 8, wherein the nitrocarburized surface layer has a thickness of approximately 5 to 20 μm, preferably approximately 10 μm.

10. The high-pressure pump according to claim 9, wherein the coating of friction-reducing paint has a thickness of approximately 10 to 50 μm, preferably approximately 15 to 30 μm.

11. The high-pressure pump according to claim 10, wherein the ring comprises an alloy 16MnCrS5.

12. The high-pressure pump according to claim 9, wherein the ring comprises an alloy 16MnCrS5.

13. The high-pressure pump according to claim 8, wherein the coating of friction-reducing paint has a thickness of approximately 10 to 50 μm, preferably approximately 15 to 30 μm.

14. The high-pressure pump according to claim 8, wherein the ring comprises an alloy 16MnCrS5.

15. A high-pressure pump for a fuel injection system of an internal combustion engine, the pump comprising a rotationally driven drive shaft including a shaft portion, embodied eccentrically to the axis of rotation of the drive shaft, a ring is rotatably supported on the shaft portion, at least one pump element having a pump piston resting at least indirectly on the ring and driven at least indirectly in a reciprocating motion by the drive shaft via the ring, and a coating of a friction reducing paint on the ring at least on the outer face facing away from the shaft portion in at least one region in which the at least one pump piston rests at least indirectly on the ring, further comprising at least one flat face on the circumference of the ring, on which flat face the pump piston rests at least indirectly and which is provided with the coating of friction-reducing paint, wherein the ring, at least in the region in which the coating of friction-reducing paint is applied, comprises a nitrocarburized surface layer, onto which the coating of friction-reducing paint is applied.

16. The high-pressure pump according to claim 15, wherein the nitrocarburized surface layer has a thickness of approximately 5 to 20 μm, preferably approximately 10 μm.

17. The high-pressure pump according to claim 16, wherein the coating of friction-reducing paint has a thickness of approximately 10 to 50 μm, preferably approximately 15 to 30 μm.

18. The high-pressure pump according to claim 16, wherein the ring comprises an alloy 16MnCrS5.

19. The high-pressure pump according to claim 15, wherein the coating of friction-reducing paint has a thickness of approximately 10 to 50 μm, preferably approximately 15 to 30 μm.

20. The high-pressure pump according to claim 15 wherein the ring comprises an alloy 16MnCrS5.

* * * * *